US005987830A

United States Patent [19]

Worley

[11] Patent Number: 5,987,830

[45] Date of Patent: Nov. 23, 1999

[54] INSULATED CONCRETE WALL AND TIE ASSEMBLY FOR USE THEREIN

[75] Inventor: Ross W. Worley, Kansas City, Mo.

[73] Assignee: Wall Ties & Forms, Inc., Shawnee, Kans.

[21] Appl. No.: 09/229,209

[22] Filed: Jan. 13, 1999

[51] Int. Cl.[6] ..... E04B 2/34

[52] U.S. Cl. ..... 52/309.11; 52/282.1; 52/309.12; 52/309.17; 52/426; 52/699; 52/780; 52/742.14; 52/745.09; 249/33; 249/40; 249/41; 249/190

[58] Field of Search ..... 52/282.1, 309.11, 52/309.12, 309.17, 426, 699, 780, 742.14, 745.09; 249/33, 40, 41, 190

[56] References Cited

U.S. PATENT DOCUMENTS

| | | | |
|---|---|---|---|
| 4,239,173 | 12/1980 | Sawyer | 249/190 X |
| 4,805,366 | 2/1989 | Long | 52/309.11 |
| 4,829,733 | 5/1989 | Long | 52/309.11 |
| 5,194,323 | 3/1993 | Savoy . | |
| 5,270,108 | 12/1993 | Savoy . | |
| 5,431,368 | 7/1995 | Wilde | 249/40 X |
| 5,673,525 | 10/1997 | Keith et al. | 52/309.11 |
| 5,852,907 | 12/1998 | Tobin et al. | 249/40 X |

*Primary Examiner*—Christopher T. Kent
*Attorney, Agent, or Firm*—Shook, Hardy & Bacon LLP

[57] ABSTRACT

An insulated concrete wall is constructed by securing at least one tie assembly (14) to a panel (12) of insulative material, securing the tie assembly and panel to a pair of spaced forms (60, 68), and pouring concrete into an open space defined by the forms adjacent the panel. The concrete is then allowed to set, and the forms are removed. The tie assembly (14) includes an elongated tie (16) having a central region (24) adapted to remain in place in the wall subsequent to construction and a pair of opposing end regions (26, 28) adapted to be detached after removal of the forms. In addition, the assembly (14) includes an elongated retainer body (18) formed of heat insulative material and received on the tie (16), and a pair of face plates (20, 22) retained on the body on either side of the panel (12).

16 Claims, 2 Drawing Sheets

3.
4.
6.
10
12
14
16
18
20
22
24
26
28
30
32
34
36
50
52
54
56
58
66

INSULATED CONCRETE WALL AND TIE ASSEMBLY FOR USE THEREIN

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

The present invention relates generally to buildings including poured concrete walls, and more particularly, to an insulated concrete wall and a tie assembly for use therein. A method of constructing the wall is also provided.

It is known to construct an insulated concrete wall by employing a forming system comprised of insulative panels that are assembled and secured together in spaced relationship by a plurality of elongated ties such that a space is defined between the panel forms into which concrete may be poured. The insulative panels both define the form and remain in place subsequent to setting of the concrete to insulate the wall against heat transfer, and the elongated ties define the size of the interior space to be filled by the poured concrete. In addition, notches formed in the ties allow rebar or other reinforcing materials to be secured in place prior to pouring of the concrete.

A known problem in the conventional construction is that because the insulative panels define the form, insulation must be provided on both sides of the concrete layer, whether desired or not. As such, it is not possible to form the wall with only exterior insulation, and finishing of the insulated interior surface is complicated. In addition, there are many known benefits to the use of conventional aluminum forms which are not available when insulative panels are used in place thereof

BRIEF SUMMARY OF THE INVENTION

It is an object of the present invention to solve the technical problems left unaddressed by the prior art, and to provide an insulated wall that is constructed using conventional aluminum forms.

It is another object of the invention to provide a novel tie assembly for use in the construction of an insulated concrete wall, wherein the tie assembly permits the wall to be constructed through the use of conventional aluminum forms or the like, and retains a layer of insulative material in place in the forms during and subsequent to pouring of the concrete.

It is another object of the invention to provide a method of constructing an insulated concrete wall, wherein a layer of insulative material is retained in place between a pair of conventional forms during and subsequent to pouring of the concrete.

In accordance with these and other objects evident from the following description of a preferred embodiment of the invention, a concrete wall is provided which includes a layer of concrete and at least one layer of insulative material. A tie assembly is provided for retaining the layer of insulative material against the concrete in the wall. The tie assembly includes an elongated retainer body formed of heat insulative material and including a first region embedded in the concrete and a second region extending through the layer of insulative material to an exterior surface of the wall. A first face plate formed of synthetic resin material is retained on the body at the outer end of the second region against the layer of insulative material, and a second face plate is retained on the first region of the body and is at least partially embedded in the concrete. The face plates are spaced from one another by a distance adapted to accommodate the layer of insulative material so that the material is retained against the concrete in the insulated wall.

By providing a construction in accordance with the present invention, numerous advantages are realized. For example, by providing a wall in which a layer of insulative material is retained in place by a tie assembly that is partially embedded in the concrete layer of the wall and that includes a body formed of a heat-insulative material, a construction results that exhibits excellent resistance to heat transfer. Further, by providing the tier assembly with a pair of face plates, it is possible to support the layer of insulative material against the concrete layer during and subsequent to pouring of the concrete, improving the integrity of the wall relative to conventional constructions.

A particular tie assembly constructed in accordance with the present invention includes an elongated tie having a central region adapted to remain in place in the wall subsequent to construction and a pair of opposing end regions adapted to be detached during construction. An elongated retainer body formed of heat insulative material is sized for receipt on the tie, and the retainer body includes a first region substantially overlying the central region of the tie and being adapted to be embedded in the concrete, and a second region overlying one of the end regions of the tie and being adapted to extend through the layer of insulative material to one of the exterior surfaces of the wall. A first face plate formed of synthetic resin material is retained on the body at an outer end of the second region, and a second face plate is retained on the first region of the body, the face plates being spaced from one another by a distance adapted to accommodate the layer of insulative material so that the material is retained against the concrete in the insulated wall.

By providing a tie assembly in accordance with the invention, it is possible to retain a layer of insulative material in place between a pair of conventional aluminum forms such that the insulative material forms a layer of the finished wall. In addition, the exposed face plates of the assemblies present outer surfaces to which siding or any other surface treatment may be secured, eliminating the need for securing such treatment to the underlying cement layer of the wall.

A method of constructing an insulated concrete wall in accordance with the present invention includes securing a number of tie assemblies to a panel of insulative material, and then securing the ends of the assemblies between opposing aluminum forms or the like. Thereafter, concrete is poured into the open space defined between the forms while the tie assemblies hold the panel in place. Once the concrete has set, the forms are removed and the ends of the tie assemblies are detached, leaving the completed wall.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figures 1, 2, 3:
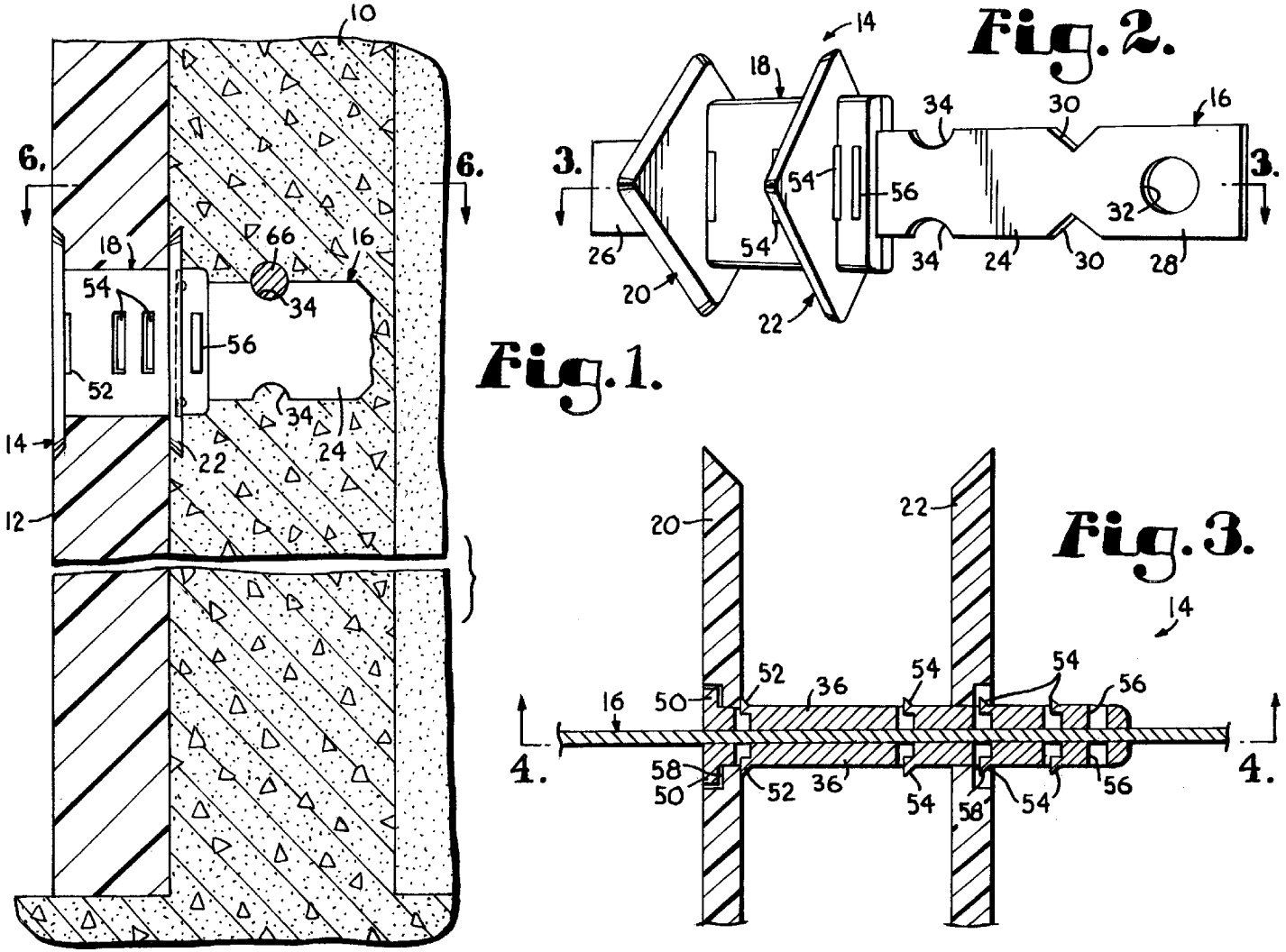
FIG. 1 is a fragmentary sectional view of an insulated concrete wall constructed in accordance with the preferred embodiment of the present invention.
FIG. 2 is a perspective view of a tie assembly adapted for use in constructing the insulated concrete wall of FIG. 1.
FIG. 3 is a sectional view taken along line 3—3 of FIG. 2.

An insulated concrete wall constructed in accordance with the preferred embodiment of the present invention is illustrated in FIG. 1, and broadly includes a layer 10 of concrete, a layer 12 of heat insulative material, and a plurality of tie assemblies 14 for retaining the insulative layer against the concrete layer during and subsequent to formation of the wall. The layer 10 of concrete is formed by pouring the concrete into a space defined between a pair of conventional aluminum forms or the like, and comprises a conventional cement composition known in the art.

Figure 6:
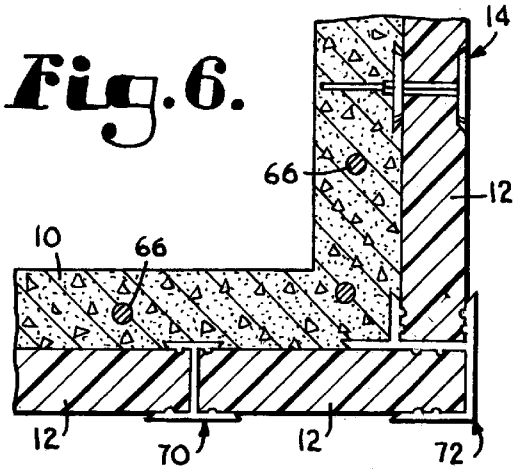
FIG. 6 is sectional view taken along line 6—6 of FIG. 1, illustrating a pair of joint barriers forming a part of the wall.

The insulative layer 12 is defined by a plurality of pre-formed panels of expanded polystyrene or the like, wherein each panel is generally rectangular in shape, e.g. having dimensions of 4'×8', and includes a uniform thickness of, e.g. one to two inches. Each panel presents opposing parallel side edges and opposing upper and lower edges, all of which present generally planer edge surfaces such that the panels may be placed flush with adjacent panels, as shown in FIG. 6, to form a substantially continuous layer of insulative material coextensive with the area of the wall. Although an expanded polystyrene material is preferred, other types of insulative panels or layers may also be used, so long as the material chosen is capable of being supported on the tie assemblies during construction of the wall as described herein.

As illustrated in FIG. 2, each tie assembly used in the wall generally includes a tie 16, a retainer body 18 received on the tie, and a pair of spaced face plates 20, 22 fastened to the retainer body. The tie 16 is formed of steel or any other suitable material, and presents a generally rectangular side elevational shape, including a central region 24 adapted to remain in place in the wall subsequent to construction and a pair of opposing end regions 26, 28 adapted to be detached during construction. The tie is of uniform thickness, and includes a pair of reduced cross sectional areas, each dividing the central region of the tie from one of the end regions to facilitate detachment of the end regions. Preferably, each reduced cross sectional area is formed by a pair of opposing V-shaped notches 30 formed in the upper and lower edges of the tie between the central region 24 and each of the end regions 26, 28 thereof.

Each end region 26, 28 includes a hole 32 by which the tie can be secured to a conventional aluminum form or the like during construction of the wall, and the central region 24 is provided with opposing notches 34 adapted to support a piece of rebar or the like such that the rebar can be secured in place prior to pouring of the concrete. Preferably, the end region 28 is adapted to protrude from the concrete layer 10 of the wall, and includes a length shorter than that of the opposing end region 26 which is adapted to protrude through substantially the entire thickness of the insulative layer 12. This construction permits removal of the region 26 from within the insulative layer of the finished wall, improving the heat insulative characteristics of the wall.

The retainer body 18 is formed from a high-strength, heat-insulative material, e.g. a synthetic resin such as nylon or the like, and includes two identical body elements 36. Each body element includes an outer surface, an inner surface and a pair of axially opposed ends.

Figure 4:
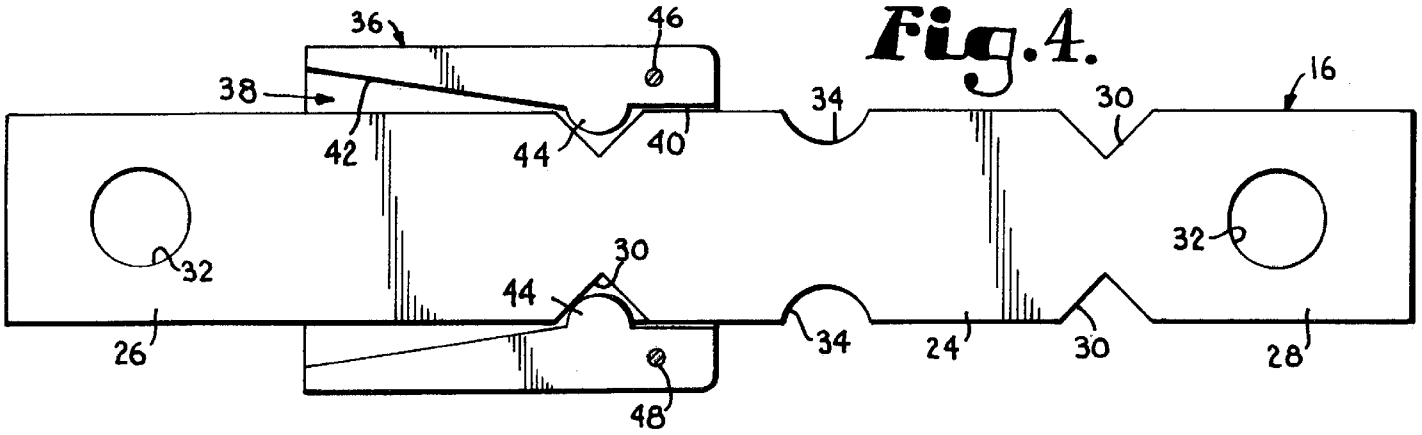
FIG. 4 is a sectional view taken along line 4—4 of FIG. 3.

The inner surface of each element is shown in FIG. 4, and includes an elongated channel 38 centrally disposed in the element and sized for receipt of the tie 16. The channel 38 includes a pair of longitudinally spaced end regions 40, 42 that are separated from one another by a pair of opposing semi-circular protrusions 44 that extend laterally into the channel from opposite sides thereof. Each of the protrusions 44 is sized for receipt in one of the notches 30 of the tie 16 such that the retainer body is fixed axially relative to the tie when the body elements are assembled on the tie. The end region 40 of each channel is of a width only slightly greater than the width of the tie so that the body remains relatively fixed in place on the central region of the tie during use. However, the opposite end region 42 of each channel includes a width that is tapered such that the width is smaller adjacent the projections 44 than at the opposite end of the region adjacent the end of the body. As described below, this tapered region 42 of the channel is adapted to extend through the insulative layer of the wall, and enables the region 26 of the tie to be broken off from the central region at a point lying at or slightly inside of the interior surface of the insulative layer, improving the heat insulative characteristics of the wall.

Each element 36 of the retainer body also includes at least one protrusion 46 and at least one hole 48 that extend from the inner surface thereof for permitting the two elements to be oriented relative to one another during assembly. Preferably, the protrusion 46 and the hole 48 are located directly opposite one another relative to the longitudinal axis of the element so that the two elements are identical to one another and the protrusion of one of the elements can be fitted into the hole of the other element, facilitating easy assembly. However, any other known mechanism or construction can be employed to aid in assembling the elements.

Turning to FIG. 3, the outer end of each retainer body element 36 is generally planer, presenting a flat end surface adapted to be exposed at an exterior surface of the finished wall. A laterally extending or protruding flange or shoulder 50 is formed adjacent the axial end of each element, and is preferably flush with the end surface. A first detent 52 is formed in each element adjacent the flange, and is spaced from the flange by a distance sized for receipt of one of the face plates 20 so that the face plate is retained axially on the body between the flange and the detent. A plurality of second detents 54 are also formed in each body element 36, wherein the second detents are spaced from one another and from the first detent 52 such that the second face plate 22 may be retained on the body at any one of three different fixed distances from the first detent. The spacing between the first detent 52 and each of the second detents 54 corresponds to the thickness of a conventional insulative panel adapted for use in the wall, e.g. 1", 1.5" and 2". However, any desired dimensions could be employed in order to position the face plates on the body in such positions that the face plates sandwich the panel of insulative material and hold the panel in place relative to the retainer body during and subsequent to construction of the wall.

In addition to the flange 50 and the detents 52, 54, each retainer body element 36 also includes a slot 56 protruding through the element at the end thereof opposite the flange. These slots are spaced axially outward from the detents such that the slots are exposed to the concrete layer during construction of the wall and become filled with concrete, anchoring the retainer body in place in the wall.

The face plates 20, 22 are preferably identical to one another, and are formed of any suitable synthetic resin material capable of receiving conventional threaded screws or the like subsequent to completion of the wall. By forming at least the outer face plate 20 of such a material, finishing work on the wall is greatly simplified, and the need for self-tapping cement screws or other complex fasteners to secure finishing materials to the wall is obviated. Further, because it is not necessary to form the inner face plate 22 of a material capable of receiving threaded screws, it can be formed of any desired material capable of anchoring the tie assembly in the cement layer of the wall. For example, a steel plate having a shape substantially identical to that shown in the drawing figures can be used, wherein a central elongated slot is provided for permitting the face plate to be received on the retainer body. In addition, instead of employing a tapered edge on the face plate, it is possible to provide apertures in the face plate that are punched or otherwise deformed to present a cavity within which cement can seep during pouring. As such, the steel face plate can be constructed in order to provide a means for seating the face plate in the concrete layer of the wall.

Each face plate 20, 22 is generally planer, including opposed parallel end surfaces and a peripheral edge that extends between the surfaces. The edge is beveled inward toward the first surface to define a dove tail that permits the face plate to be embedded in the layer of concrete during construction, and that allows the face plate to press into the panel under the weight of the concrete when poured. A slot 58 is formed in each face plate that is sized for receipt of the retainer body. The width of each slot accommodates the body but engages the detents 52, 54 such that the axial position of the face plates on the body can only be achieved by forcing the face plates over the detents during assembly. In addition, the side edges of each slot are stepped, presenting a notch within which the flange 50 of the body is received when the face plate 20 is pressed into position at the end of the body. As such, the face plate 20 and the end surface of the body I 8 present a planer surface that is parallel to the exterior surface of the insulative layer, facilitating finishing work on the wall.

Although the face plates 20, 22 are illustrated as being diamond shaped, it is noted that any desired shape could be employed so long as the face plates present an area sufficient to enable screws and the like to be driven into the face plates to support any finishing materials on the wall.

Figure 5:
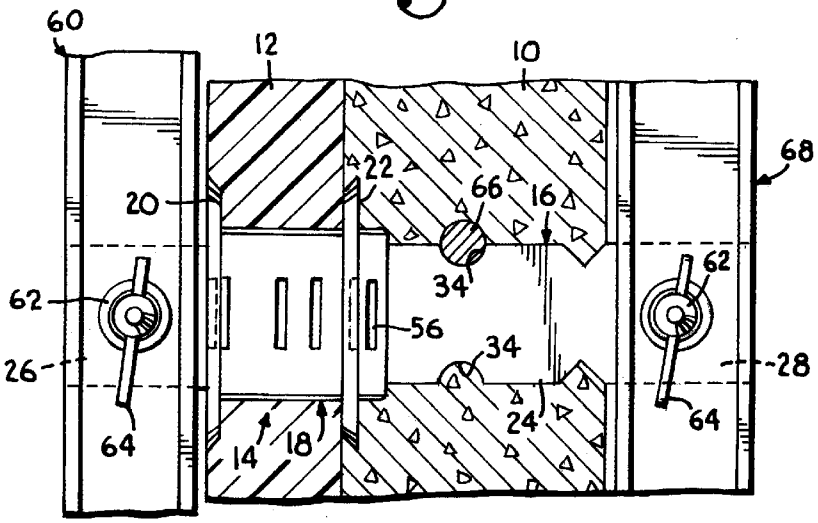
FIG. 5 is a fragmentary sectional view of the insulated concrete wall during construction.

With reference to FIG. 5, in order to construct a wall in accordance with the present invention, a number of tie assemblies are first secured in place on one or more panels of insulative material at spaced locations on each panel. Preferably, this assembly includes the steps of mating the elements 36 and positioning the face plate 20 against the flange 50, and sliding the body on the tie until the projections of the elements engage the notches of the tie. Thereafter, the tie assembly is pushed through a corresponding slot cut or otherwise formed in the panel, and the other face plate 22 is pushed into place on the body, sandwiching the panel between the two face plates and retaining it in place relative to the tie.

Once all of the tie assemblies on a particular panel 12 are in place, the panel is arranged in position at the site of the wall, and outer forms 60 are positioned against the panel and secured in place. The outer ends 26 of the ties are secured to the outer forms by aligning the holes 32 in the ties with corresponding holes in the forms, and tapered pins 62 are placed through the holes to secure the ties and forms in place. Preferably, the tapered pins are slotted, and wedges 64 are driven into the slots to drive the forms together and secure the ties in place. However, any other conventional mechanism could be employed as would be recognized by one of skill in the art. This step is repeated for any number of additional panels and forms as are required to define a the desired shape and dimensions of the wall to be constructed.

As the panels 12 and outer forms 60 are assembled, it is possible to secure rebar 66 or any other suitable reinforcement material on the wall adjacent the panels, as well as any conduit or the like to be embedded in the concrete layer. Preferably, vertical lengths of rebar are installed either at the same time or before installation of the panels, and horizontal lengths of rebar can be installed subsequent to placement of the outer forms by setting the rebar in the notches of the ties and securing it in place with wire or the like. Thereafter, inner forms 68 are assembled and secured to the ties 16 in the same manner as the outer forms 60, except that a space is defined between the inner forms 68 and the insulative panels 12 due to the lengths of the ties. This space can be any thickness desired, and is uniform across the area of the wall, the space being adapted to be filled by concrete during a subsequent pouring step that is carried out in a conventional fashion.

When concrete is poured into the space between the forms, it runs up against the panels 12 of insulative material but does not displace the panels due to the securement of the panels within the forms by the tie assemblies 14. In addition, the concrete fills the open space between the panels and the dove tail edges of the inner face plates 22 such that the tie assemblies are anchored in the concrete layer.

Subsequent to pouring and setting of the concrete, the forms 60, 68 are removed, and the end regions 26, 28 of the ties are broken off or otherwise detached from the central region, leaving only those portions of the assemblies illustrated in FIG. 1. As such, no metal extends through the panels to the exterior of the wall, and the panels 12 are retained in place by the face 20, 22 plates and retainer bodies 18 of the assemblies 14. This feature of the invention improves the insulative properties of the wall while also presenting many easily penetrable mounting plates at which surface finishing materials such as siding and the like may be secured.

As shown in FIG. 6, it is possible to secure each panel of insulated material to adjacent panels through the use of joint barriers 70, 72. The joint barrier 70 is used to secure panels together so that the two panels are disposed in a common plane, such as across the area of a planer wall, and the joint barrier 72 is adapted to connect panels together at a 90° angle, such as at a corner of the wall.

The joint barrier 72 is generally I-shaped, and includes a central web adapted to extend between a side of side-by-side panels, and a pair of opposed flanges that engage the exterior and interior surfaces of the panels and grip the panels to secure them in place against the joint barrier 70. Preferably, the flanges of the joint barrier 70 are provided with interior surfaces that are ridged so that the flanges grip the material of the panels when the panels are inserted into the joint barrier and pressed against the webb. As such, the joint barrier 70 retains the panels in place during and subsequent to construction of the wall. In addition, by constructing the joint barrier 70 of a synthetic resin material, it is possible to drive screws and other conventional fasteners into the joint barrier upon completion of the wall in order to attach finishing materials thereto.

The joint barrier 70 is generally F-shaped, and is also preferably formed of a synthetic resin material so that screws and other conventional fasteners can be driven into the joint barrier 72 once the wall is constructed. The joint barrier 72 presents a first channel defined by a pair of laterally spaced flanges, wherein the channel is sized for receipt of the edge of a first panel 12 of insulated material. Preferably, the flanges present inner surfaces that are ridged so that the panel is gripped once it is pressed into the channel defined by the joint barrier 72. Similarly, a pair of flanges are provided on the joint barrier 72 that extend in a direction perpendicular to the lengths of the flanges defining the first channel, wherein the flanges of the second channel are also ridged internally to secure a second panel 12 in place on the joint barrier in an orientation perpendicular to the orientation of the first panel. Joint barriers having other configurations may also be employed in order to secure a plurality of panels of insulated materials together during construction of the wall so that the panels remain secured in place during and subsequent to pouring of concrete into the wall.

Although the invention has been described with reference to the preferred embodiment illustrated in the attached drawing figures, it is noted that substitutions may be made and equivalents employed herein without departing from the scope of the invention as recited in the claims.

I claim:

1. A concrete wall presenting first and second exterior surfaces, comprising:

a layer of concrete;

at least one layer of insulative material; and a tie assembly for retaining the layer of insulative material against the concrete in the wall, the tie assembly including an elongated retainer body formed of heat insulative material and including a first region embedded in the concrete and a second region extending through the layer of insulative material to the first exterior surface of the wall, the second region including an outer end disposed adjacent the first exterior surface, a first face plate formed of synthetic resin material and being retained on the body at the outer end of the second region against the layer of insulative material, and a second face plate retained on the first region of the body and being at least partially embedded in the concrete the face plates being spaced from one another by a distance adapted to accommodate the layer of insulative material so that the material is retained against the concrete in the insulated wall, the retainer body including a laterally extending flange adjacent the outer end of the second region for retaining the first face plate on the body, the retainer body and first face plate presenting a generally planer outer surface disposed in a plane generally parallel to the first exterior surface of the wall.

2. A concrete wall presenting first and second exterior surfaces, comprising:

a layer of concrete;

at least one layer of insulative material; and a tie assembly for retaining the layer of insulative material against the concrete in the wall, the tie assembly including an elongated retainer body formed of heat insulative material and including a first region embedded in the concrete and a second region extending through the layer of insulative material to the first exterior surface of the wall, the second region including an outer end disposed adjacent the first exterior surface, a first face plate formed of synthetic resin material and being retained on the body at the outer end of the second region against the layer of insulative material, and a second face plate retained on the first region of the body and being at least partially embedded in the concrete the face plates being spaced from one another by a distance adapted to accommodate the layer of insulative material so that the material is retained against the concrete in the insulated wall, the second face plate including a first surface engaging the layer of insulative material, a second surface embedded in the layer of concrete, and a peripheral edge extending between the first and second surfaces and being beveled inward toward the first surface, the peripheral edge being substantially embedded in the layer of concrete to anchor the face plate in the layer of concrete.

3. A concrete wall presenting first and second exterior surfaces, comprising:

a layer of concrete;

at least one layer of insulative material; and a tie assembly for retaining the layer of insulative material against the concrete in the wall, the tie assembly including an elongated retainer body formed of heat insulative material and including a first region embedded in the concrete and a second region extending through the layer of insulative material to the first exterior surface of the wall, the second region including an outer end disposed adjacent the first exterior surface, a first face plate formed of synthetic resin material and being retained on the body at the outer end of the second region against the layer of insulative material, and a second face plate retained on the first region of the body and being at least partially embedded in the concrete the face plates being spaced from one another by a distance adapted to accommodate the layer of insulative material so that the material is retained against the concrete in the insulated wall, each of the face plates including a first surface engaging the layer of insulative material, a second surface opposite the first surface, and a peripheral edge extending between the first and second surfaces and being beveled inward toward the first surface.

4. A concrete wall presenting first and second exterior surfaces, comprising:

a layer of concrete;

at least one layer of insulative material;

a tie assembly for retaining the layer of insulative material against the concrete in the wall, the tie assembly including an elongated retainer body formed of heat insulative material and including a first region embedded in the concrete and a second region extending through the layer of insulative material to the first exterior surface of the wall, the second region including an outer end disposed adjacent the first exterior surface, a first face plate formed of synthetic resin material and being retained on the body at the outer end of the second region against the layer of insulative material, and a second face plate retained on the first region of the body and being at least partially embedded in the concrete the face plates being spaced from one another by a distance adapted to accommodate the layer of insulative material so that the material is retained against the concrete in the insulated wall, the at least one layer of insulative material including a plurality of panels of insulative material, each presenting a pair of laterally spaced side edges; and at least one joint barrier that receives the side edges of adjoining panels.

5. The wall as recited in claim 4, wherein each joint barrier includes a generally I-shaped cross section, presenting a central web and a pair of opposed flanges that are spaced from one another by a distance sized for receipt of the side edges of the panels.

6. The wall as recited in claim 4, wherein at least one joint barrier is a corner barrier including a generally F-shaped cross section and presenting a first channel sized for receipt of the side edge of one of the panels and opening in a first direction, and a second channel sized for receipt of the side edge of another of the panels and opening in a second direction, wherein the first and second directions are perpendicular to one another.

7. A tie assembly for use in an insulated wall presenting a pair of opposing exterior surfaces and being constructed of concrete and a layer of insulative material, the tie assembly comprising:

an elongated tie having a central region adapted to remain in place in the wall subsequent to construction and a pair of opposing end regions adapted to be detached during construction, the tie presenting a reduced cross sectional area between the central region and each of the end regions to facilitate detachment of the end regions;

an elongated retainer body formed of heat insulative material and sized for receipt on the tie, the retainer body including a first region substantially overlying the central region of the tie and being adapted to be embedded in the concrete, and a second region overlying one of the end regions of the tie and being adapted to extend through the layer of insulative material to one of the exterior surfaces of the wall, the second region including an outer end spaced from the first region;

a first face plate formed of synthetic resin material and being retained on the body at the outer end of the second region; and a second face plate retained on the first region of the body, the face plates being spaced from one another by a distance adapted to accommodate the layer of insulative material so that the material is retained against the concrete in the insulated wall.

8. The tie assembly as recited in claim 7, wherein the retainer body includes a laterally extending flange adjacent the outer end of the second region for retaining the first face plate on the body.

9. The tie assembly as recited in claim 7, wherein the second face plate includes opposing first and second surfaces and a peripheral edge extending between the first and second surfaces and being beveled inward toward the first surface.

10. The tie assembly as recited in claim 7, wherein each of the face plates includes opposing first and second surfaces and a peripheral edge extending between the first and second surfaces and being beveled inward toward the first surface.

11. The tie assembly as recited in claim 7, wherein the retainer body is formed from a pair of body elements, each presenting a longitudinally extending inner channel shaped for receipt of the tie.

12. The tie assembly as recited in claim 11, wherein the channel in each body element includes a first region adapted to receive the central region of the tie and a second region adapted to receive one of the end regions of the tie, the second region of the channel including a width that is tapered such that the width of the channel is smaller adjacent the first region of the channel than at a distance spaced from the first region of the channel.

13. The tie assembly as recited in claim 8, wherein the retainer body includes a first detent for retaining the first face plate on the body adjacent the flange.

14. The tie assembly as recited in claim 13, wherein the retainer body includes at least one second detent for retaining the second face plate on the body at a position spaced from the first face plate.

15. The tie assembly as recited in claim 13, wherein the retainer body includes a plurality of second detents for retaining the second face plate on the body at a position spaced from the first face plate, the second detents being spaced from one another on the retainer body.

16. A method of constructing an insulated concrete wall comprising the steps of:

securing at least one tie assembly to a panel of insulative material, the tie assembly including an elongated tie having a central region, a pair of opposing end regions, and a reduced cross sectional area between the central region and each of the end regions, an elongated retainer body formed of heat insulative material and received on the tie, and a pair of face plates retained on the body on either side of the panel;

securing one of the end regions of the at least one tie assembly to a first form;

securing the other of the end regions to a second form spaced from the first form by a distance greater than the thickness of the panel so that an open space is defined between the first and second forms adjacent the panel;

pouring concrete into the open space between the first and second forms, the at least one tie assembly holding the panel in place between the forms during the pouring step;

allowing the concrete to set;

removing the first and second forms; and detaching the end regions of the ties.

* * * * *